US005620308A

United States Patent [19]

Yoshinari et al.

[11] Patent Number: 5,620,308

[45] **Date of Patent: *Apr. 15, 1997**

[54] GAS TURBINE, GAS TURBINE BLADE USED THEREFOR AND MANUFACTURING METHOD FOR GAS TURBINE BLADE

[75] Inventors: Akira Yoshinari; Tosiaki Saito, both of Katsuta; Katsumi Iijima; Tadami Ishida, both of Hitachi; Ryozo Hashida, Katsuta; Kimio Kano, Sendai, all of Japan

[73] Assignees: Hitachi, Ltd., Tokyo; Tohoku Electric Power Co., Inc., Miyagi-ken, both of Japan

[ * ] Notice: The term of this patent shall not extend beyond the expiration date of Pat. No. 5,489,194.

[21] Appl. No.: 486,292

[22] Filed: Jun. 7, 1995

Related U.S. Application Data

[60] Division of Ser. No. 290,294, Aug. 15, 1994, Pat. No. 5,489,194, which is a continuation-in-part of Ser. No. 760, 076, Sep. 13, 1991, abandoned.

[30] Foreign Application Priority Data

Sep. 14, 1990 [JP] Japan ..... 2-245210

[51] Int. Cl.[6] ..... F01D 5/14

[52] U.S. Cl. ..... 416/241 R; 416/223 A; 29/889; 29/889.7; 164/122.1

[58] Field of Search ..... 416/223 A, 239, 416/241 R, 219 R, 220 R, 248; 164/122.1, 122.2; 29/889, 889.2, 889.7, 889.72, 889.721

[56] References Cited

U.S. PATENT DOCUMENTS

| | | |
|---|---|---|
| 3,494,709 | 2/1970 | Piearcey . |
| 3,939,895 | 2/1976 | Sawyer . |
| 4,057,097 | 11/1977 | Lux et al. . |
| 4,178,986 | 12/1979 | Smashey . |
| 4,337,071 | 6/1982 | Yang . |
| 4,416,321 | 11/1983 | Goddard et al. . |
| 4,469,161 | 9/1984 | Higginbotham et al. . |
| 4,637,448 | 1/1987 | Burke et al. . |
| 5,062,469 | 11/1991 | Monte et al. . |
| 5,113,582 | 5/1992 | Monson et al. . |

FOREIGN PATENT DOCUMENTS

| | | |
|---|---|---|
| 4185 | 11/1976 | Japan . |
| 40664 | 3/1985 | Japan . |
| 63-171845 | 7/1988 | Japan . |
| 1303027 | 1/1973 | United Kingdom . |
| 2100633 | 1/1983 | United Kingdom . |

OTHER PUBLICATIONS

An Alternative Process for the Manufacture of Single Crystal Gas Turbine Blades, Sulzer Technical Review Mar. 1988, by F. Staub, et al., pp. 11–16.

Nickel Base Superalloys Single Crystal Growth Technology for Large Size Buckets in Heavy Duty Gas Turbines, Presented to the International Gas Turbine and Aeroengine Congress and Exposition, Orlando, Florida, Jun., 1991, by A. Yoshinari, et al., pp. 1–6.

*Primary Examiner*—John T. Kwon

*Attorney, Agent, or Firm*—Antonelli, Terry, Stout & Kraus

[57] ABSTRACT

A heavy-duty gas turbine includes a compressor; a combustion liner; a turbine blade in a single stage or multi-stages; and a turbine nozzle provided in correspondence to the turbine blade. The turbine blade has a dovetail secured to a turbine disk and has an overall length of not less than 180 mm, and it is made of a single-crystal Ni-base alloy whose γ phase is a single crystal. Operating gas temperature is not less than 1400° C., and metal temperature of a first blade is not less than 1000° C. under working stress.

30 Claims, 3 Drawing Sheets

GAS TURBINE, GAS TURBINE BLADE USED THEREFOR AND MANUFACTURING METHOD FOR GAS TURBINE BLADE

RELATED APPLICATIONS

This application is a division of application Ser. No. 08/290,294, filed Aug. 15, 1994, now U.S. Pat. No. 5,489,194 issued Feb. 6, 1996, which in turn is a continuation-in-part application of application Ser. No. 07/760,076 filed Sep. 13, 1991 and now abandoned.

BACKGROUND OF THE INVENTION

1. Field of the Invention

The present invention relates to a gas turbine, a heavy-duty gas turbine blade, which has horizontally extending protrusions, and a manufacturing method for the gas turbine blade.

2. Description of the Prior Art

Primarily Ni-base superalloys have been used as materials for the rotor blades of electricity generating gas turbines. To improve the thermal efficiency of gas turbines, the temperature of gas has been increased year after year. To cope with such an increase in the gas temperature, conventional casting blades having complicated cooling holes therein have been employed.

Single-crystal vanes have already been used as rotor blades of aircraft jet engines. Alloys for casting the single-crystal vane are developed on the assumption that they do not have grain boundaries, and therefore they do not contain grain boundary strengthening elements such as B, Zr and Hf. For this reason, the grain boundaries of single-crystal alloys are weak. At least a portion of a casting must be single-crystallized before the casting can be used. In order to use the single-crystal vane as a gas turbine rotor blade, it is indispensable for the entire casting to be single-crystallized.

Most single-crystal castings are manufactured by a unidirectional solidification process disclosed in Japanese Patent Laid-Open Nos. 51-41851 and 1-26796. This process is a process in which a casting is withdrawn downwardly from a heated furnace and is solidified gradually from the lower end to the upper end thereof.

The rotor blade for the aircraft jet engine has a length of approximately 10 cm, and the cross-section area of a shaft is 10 $cm^2$ at the largest. The size of a platform extending horizontally from the main body of the rotor blade is small. Because the entire rotor blade is such a small component, a single-crystal vane can be manufactured by solidifying a vane-shaped casting through the above unidirectional solidification process.

However, rotor blades in electricity generating gas turbines are larger than those in aircraft jet engines. The former have a length of 14–16 cm or more and shanks having a cross-section area of 15 $cm^2$ or more. It is therefore difficult to manufacture the former in a single-crystal structure. There are portions, such as the platform and sealing portions extending from the side of the shank, protruding horizontally from the direction in which the casting is solidified. Even when the casting is solidified by the conventional unidirectional solidification process, the entire casting cannot be single-crystallized. The following reason may be attributed to the non-single crystallization. When the casting is solidified, the horizontally protruding portion begins to solidify from the outer periphery of the casting. Since the horizontally protruding portion has no relationship with the other portion of the casting, it will have a crystal orientation different from that of the other portion. When this portion and the other portion of the casting are further solidified and the crystals of both come into contact with each other, the contacting surface is formed into a grain boundary, thus preventing a single crystal from growing.

It is thus impossible to form an entire large turbine blade for use in an electricity generating gas turbine in a single-crystal structure.

SUMMARY OF THE INVENTION

An object of the present invention is to provide a large single-crystal turbine blade excellent in tensile and creep strength and in thermal fatigue performance at heat and stress. Another object of the invention is to provide a manufacturing method for such a turbine blade. A further object is to provide a heavy-duty gas turbine having high thermal efficiency.

To achieve the above objects, this invention provides a gas turbine blade comprising a dovetail serving as a portion secured to a disk, with a shank being connected to the dovetail and having one or more protrusions integrally formed on the side of the dovetail, and with a vane being connected to the shank. The gas turbine blade is made of a Ni-base alloy in which a $\gamma'$ phase is precipitated substantially in a $\gamma$ phase which is formed in a single-crystal structure.

The protrusions provided in the shank of the turbine blade may be sealing portions, in a single stage or multistages, provided on both surfaces along a surface where the vane rotates. The edge of the sealing portion bends towards the vane. The protrusion provided in the shank is one platform provided on both surfaces intersecting with the surface where the vane rotates. The shank, in which the protrusions are provided, has a cross-section area of not less than 15 $cm^2$. The shank and the vane including the dovetail and the protrusions are made of the Ni-base alloy in which the $\gamma'$ phase is precipitated in a single-crystal base of the $\gamma$ phase. The gas turbine blade has an overall length of not less than 160 mm. The vane weighs not more than 30%, particularly 20–30%, of the overall weight of the gas turbine blade.

This invention also provides a manufacturing method for a gas turbine blade including a dovetail serving as a portion secured to a disk wherein a shank is connected to the dovetail and has protrusions integrally formed on the side of the dovetail, and a vane is connected to the shank. A by-pass mold corresponding to the protrusions is connected to a main mold corresponding to the dovetail, the shank and the vane, with a single-crystal structure being cast by gradually solidifying at the same speed in one direction molten metal of Ni-base alloy in the main mold and the by-pass mold.

The invention further provides a gas turbine blade comprising a dovetail serving as a portion secured to a disk, with a shank being connected to the dovetail and having one or more protrusions integrally formed on the side of the dovetail, and with a vane being connected to the shank. The gas turbine blade is solidified from an edge of the vane to the dovetail by a unidirectional solidification process, with a $\gamma$ phase being made of a single-crystal Ni-base alloy.

The invention provides a heavy-duty gas turbine comprising, a compressor, a combustion liner, a turbine blade, in a single stage or multi-stages, which has a dovetail secured to a turbine disk and has an overall length of not less than 160 mm, and which is made of a single-crystal Ni-base alloy whose $\gamma$ phase is a single crystal. A turbine nozzle is provided in correspondence to the turbine blade wherein an operating gas temperature is not less than 1400° C., and metal temperature of a first blade is not less than 1000° C. under working stress.

In order for the gas turbine blade to solidify in one direction, the mold having the by-pass formed in the protrusion is employed separately from the other mold used for the dovetail, the shank and the vane. The manufacturing method for the gas turbine blade, according to this invention, is capable of manufacturing a large gas turbine blade having a complicated configuration and the single-crystal structure.

Although the turbine blade of the invention is a large blade having the protrusion formed where the cross-sectional area of the blade is 15 $cm^2$ or more, it has more strength than a blade made of a polycrystal having grain boundaries because it is made in the single-crystal structure.

Desirably, Ni-base alloys should be used for the turbine blade in this invention, each alloy containing by weight 0.15% or less C or preferably 0.02% as an impurity; 0.03% or less Si; more preferably an impurity; 2.0% or less Mn; 5–18.4% Cr; 1–12% Al; 1–5% Ti; 2.0% or less Nb; 1.5–15% W; 5% or less Mo; 12% or less Ta, more preferably 2–10%; 15% or less Co; 0.2% or less Hf; 3.0% or less Re; and 0.02% or less B. Table 1 shows the above Ni-base alloys, indicating weight percent of the elements in the alloys.

Because the characteristics of the single-crystal rotor blade of the invention are excellent at high temperatures, the service life of the blade is extended, the thermal efficiency of the gas turbine caused by an increase in the fuel gas temperature is increased to 34%.

TABLE 1

| No. | Cr | Mo | W | Re | Al | Ti | Ta | Co | Hf | Nb | Ni |
|---|---|---|---|---|---|---|---|---|---|---|---|
| 1 | 10.0 | — | 4.0 | — | 5.0 | 1.5 | 12.0 | 5.0 | — | — | Bal |
| 2 | 9.0 | 1.0 | 10.5 | — | 5.8 | 1.2 | 3.3 | — | — | — | Bal |
| 3 | 9.0 | 1.5 | 6.0 | — | 3.7 | 4.2 | 4.0 | 7.5 | — | 0.5 | Bal |
| 4 | 6.6 | 0.6 | 6.4 | 3.0 | 5.6 | 1.0 | 6.5 | 9.6 | 0.1 | — | Bal |
| 5 | 5.6 | 1.9 | 10.9 | — | 5.1 | — | 7.7 | 8.2 | — | — | Bal |
| 6 | 10.0 | 0.7 | 6 | 0.1 | 5.4 | 2 | 5.4 | 4.5 | — | — | Bal |
| 7 | 18.4 | 3.0 | 1.5 | — | 2.5 | 5.0 | — | 15.0 | — | B0.02 | Bal |
| 8 | 8.5 | — | 9.5 | — | 5.5 | 2.2 | 2.8 | 5.0 | — | — | Bal |
| 9 | 10.0 | 0.7 | 2.0 | 0.25 | 12.0 | 1.2 | 2.6 | — | — | — | Bal |
| 10 | 6.6 | — | 12.8 | — | 5.2 | — | 7.7 | — | — | — | Bal |

TABLE 2

| No. | C | Cr | Ni | Co | Mo | W | Nb | Ti | Al | Fe | B | Zr | Ta |
|---|---|---|---|---|---|---|---|---|---|---|---|---|---|
| 11 | 0.38 | 20.0 | 20.0 | Bal | 4.0 | 4.0 | 4.0 | — | — | 4.0 | — | — | — |
| 12 | 0.45 | 21.0 | ≦1.0 | Bal | — | 11.0 | 2.0 | — | — | 2.0 | — | — | — |
| 13 | 0.25 | 29.5 | 10.5 | Bal | — | 7.0 | — | — | — | 2.0 | 0.01 | — | — |
| 14 | 0.60 | 24.0 | 10.0 | Bal | — | 7.0 | — | 0.2 | — | — | — | 0.5 | 3.5 |
| 15 | 0.60 | 24.0 | 10.0 | Bal | — | 7.0 | — | 0.25 | 0.18 | — | — | — | 3.5 |

Desirably, Co-based alloys may be used in this invention, each alloy containing by weight 0.2–0.6% C; 0.5% or less Si; 2% or less Mn; 20–30% Cr; 20% or less Ni; 5% or less Mo; 2–15% W; 5% or less Nb; 0.5% or less Ti; 0.5% or less Al; 5% or less Fe; 0.02% or less B; 0.5% or less Zr; 5% or less Ta; and the remaining weight percent constitutes Co. Table 2 shows the above Co-based alloys, used for a turbine nozzle serving as a stator blade, indicating weight percent of the elements in the alloys.

The gas turbine of this invention is more efficient because it is large and permits an operating gas temperature to increase to 1400° C. or more at an early stage of the operation.

Crystal orientation in the horizontally protruding portion with respect to the direction in which solidification advances is oriented so that it may be in the same crystal orientation as the casting. It is thus possible to efficiently manufacture the large single-crystal rotor blade.

DESCRIPTION OF THE PREFERRED EMBODIMENTS

Figure 1:
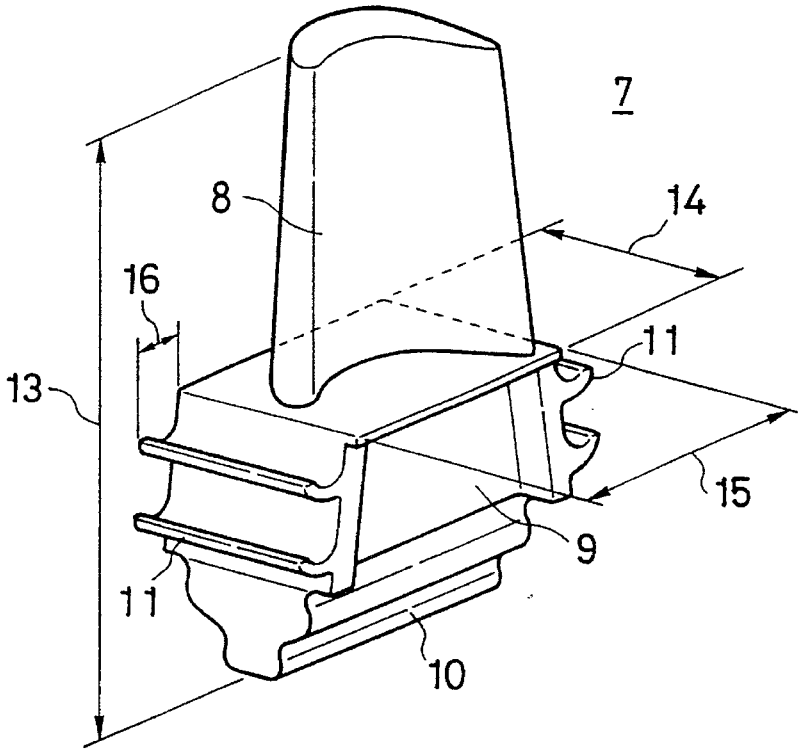
FIG. 1 is a perspective view of a turbine rotor blade in accordance with an embodiment of the present invention.
Figure 2:
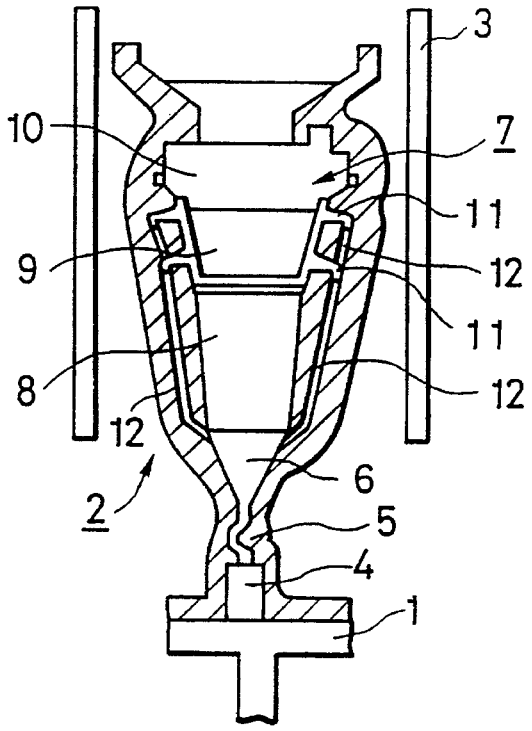
FIG. 2 is a vertical cross-sectional view of a mold, illustrating a manufacturing method for the turbine rotor blade shown in FIG. 1.

As shown in FIG. 2, first, a shell mold 2, made of alumina, is secured to a water-cooled chill 1, and is placed in a mold heating heater 3 in which it is heated to not less than the melting temperature of a Ni-base alloy. Next, a dissolved alloy is poured into the mold 2, and then the water-cooled chill 1 is withdrawn downwardly to solidify the alloy by a unidirectional solidification process. When the alloy is thus solidified, many crystals are first formed in a starter 4 at the lower end of the mold 2, and are then formed into one single crystal in a selector 5, capable of rotating 360°, while the alloy is still being solidified. The single crystal becomes larger in an enlarged section 6. The alloy is solidified and formed into a casting 7, which is composed of a vane 8 having cooling holes formed therein, a shank 9 on the vane 8, and a Christmas tree-shaped dovetail 10 on the shank 9. The vane 8, shank 9 and dovetail 10 are illustrated in an inverted position in FIG. 1. Sealing portions or protrusions 11, the end of which bend toward the vane 8, protrude from the shank 9. As shown in FIG. 2, the turbine blade is cast from the vane 8 of the turbine rotor blade to the shank 9 and the dovetail 10 shown in FIG. 1.

In this embodiment, a by-pass mold 12 different from the casing 7 is provided from the point of the enlarged section 6 to the sealing portions or protrusions 11. The provision of the by-pass mold 12 permits the entire rotor blade of the turbine to be single-crystallized. The turbine rotor blade shown in FIG. 1 measures approximately 180 mm high×40 mm wide×100 mm long, as denoted by numerals 13, 14 and 15, respectively.

The vane 8 measures approximately 90 mm high, and weighs approximately 30% of the weight of the entire turbine rotor blade. The cross-section area of the shank 9, where the sealing portions or protrusions 11 are formed, is 40 $cm^2$. The sealing portions 11 each extend approximately 15 mm.

The casting heater 3 is maintained at high temperatures until the casting 7 is withdrawn and solidified completely.

The casting process mentioned above is performed in a vacuum. After the turbine rotor blade, made from the single crystal, has been cast, it is subjected to a solution heat treatment in a vacuum at temperatures of 1300°–1350° C. for 2–10 hours. A eutectic $\gamma'$ phase formed by solidifying the alloy is changed into a $\gamma$ phase. The turbine rotor blade is then subjected to an aging treatment at temperatures of 980°–1080° C. for 4–15 hours and at temperatures of 800°–900° C. for 10–25 hours. Horn-shaped $\gamma'$ phases, each having an average size of 3–5 μm, are precipitated in the $\gamma$ phase.

Table 3 shows conditions for casting the single-crystal vane.

TABLE 3

| | |
|---|---|
| Mold heating temperature | 1560° C. |
| Pouring temperature | 1550° C. |
| Withdrawal velocity | 10 cm/h |
| Mold material | ceramic |
| Degree of vacuum | $2 \times 10^{-3}$ Torr or less |
| Alloys | Nos. 2 and 10 |

Table 4 shows the comparison between the yield of single-crystal vanes manufactured by the method of this invention and the yield of such vanes manufactured by the conventional method.

TABLE 4

| | Yields | |
|---|---|---|
| Alloys | This invention | Conventional method |
| No. 2 | 75% | 0% |
| No. 10 | 83% | 0% |

The turbine rotor blade is shrunk at the upper portion of a platform, and the secondary growth of a long, thin dendrite is found at the lower portion of the platform.

As shown in Table 2, this invention makes it possible to manufacture a large single-crystal vane which cannot be manufactured by the conventional method. In this embodiment, since the vane of the turbine rotor blade, which requires the highest strength and ductility, is first solidified, the time during which the rotor blade is in contact with the molten mold is shortened. It is possible to obtain a turbine rotor blade made of an alloy containing elements which vary little and have few defects. As a result, a turbine rotor blade having the required characteristics can be manufactured. It takes approximately one hour for the vane to solidify, and approximately two hours for the other components and the dovetail to solidify finally. The elements in an alloy vary, and particularly Cr varies greatly. As described in this embodiment, however, if a large amount of Cr, 8.5 wt % and particularly 10 wt % or more, is contained in an alloy, it varies little and is very effective in being used for turbine rotor blades. On the contrary, 8.5 wt % or less Cr varies greatly.

The by-pass mold 12, different from the mold used for forming the turbine rotor blade, may be provided in a position which is above the selector 5 in a selector method or above a seed in a seed method, and which is anywhere below the sealing portions or protrusions 11. However, after the single-crystal has been cast, the by-pass mold 12 must be removed; therefore, desirably, the by-pass mold 12 should be provided in the enlarged section 6, shown in FIG. 2, which is above the selector 5 or the seed and is below the vane 8.

The rotor blade is solidified from the vane 8 to the dovetail 10 for the following reasons. The vane 8 of the gas turbine rotor blade is the essential part of the rotor blade, and is subjected to high temperatures and stress. It therefore must possess fewer defects and be of a higher-quality than any other components. The vane 8 is first solidified, so that the time during which it is held at high temperatures is shortened. In order to make the elements vary little, such casting is suitable for manufacturing the rotor blade of the gas turbine. A plurality of cooling holes are provided leading from the vane 8 to the dovetail 10, and are used for cooling the components by a refrigerant. A core for the cooling holes is used as the mold. The speed at which the alloy is solidified varies from 1 to 50 cm/h according to the size of the casting to be solidified. The vane 8 can be solidified faster than the shank 9 and the dovetail 10.

Although the manufacturing method for the rotor blade of a gas turbine has been described, it is possible to allow a single crystal to grow for stator blades by the same method as described above.

A rotor blade having substantially the same configuration as that of the rotor blade in the first embodiment is cast using the alloy No. 2. The same casting conditions and the unidirectional solidification process as those in the first embodiment are employed in the second embodiment. The blade measures 160 mm high; a vane measures 70 mm high; and a shank and a dovetail each measure 90 mm high.

Figure 3:
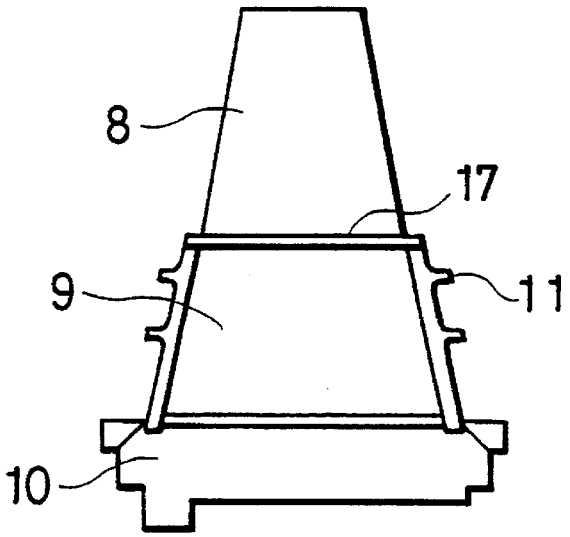
FIG. 3 is a front view showing a turbine rotor blade of another embodiment of this invention.
Figure 4:
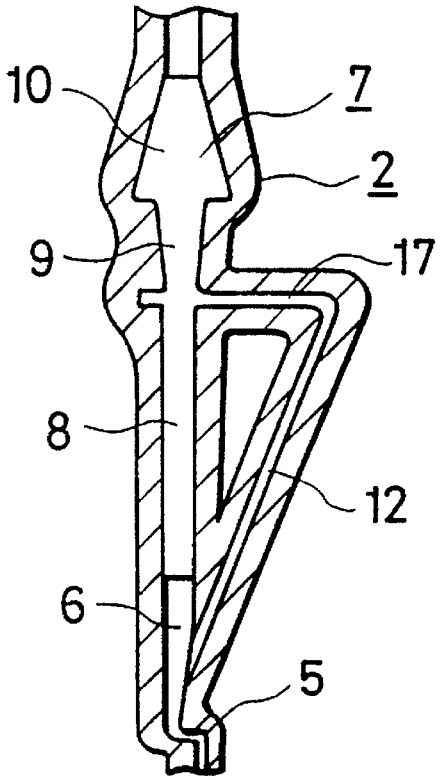
FIG. 4 is a vertical cross-sectional view of a mold, illustrating another manufacturing method for the turbine rotor blade shown in FIG. 3.
Figure 5:
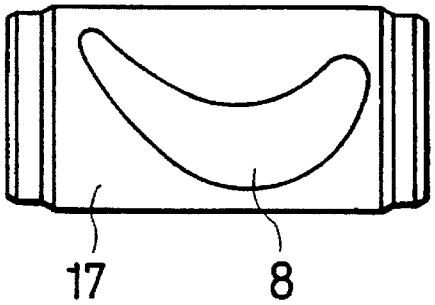
FIG. 5 is a plan view of the mold shown in FIG. 4.
Figure 6:
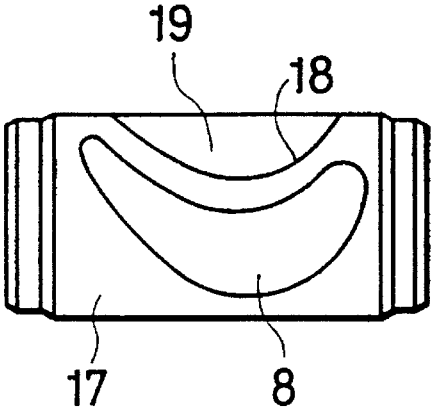
FIG. 6 is a plan view of a mold in comparison with the mold shown in FIG. 4.

In the rotor blade of FIG. 3, since the rotor blade has a wide platform 17, when it is solidified by the unidirectional solidification process, a new crystal is formed at the platform 17, thus preventing a single crystal from growing. To solve this problem, the present invention is applied to the method of manufacturing the rotor blade. As shown in FIG. 4, a portion near the edge of the platform 17 is connected to a portion above a selector 5 by a by-pass mold 12, different from the mold for forming a casting 7. Such connection makes it possible for a single crystal to grow. The by-pass mold 12 has a thickness of 1 mm and a width of 20 mm. FIG. 5 shows how the new crystal grows in the conventional method, as seen from the upper portion of the vane 8; and FIG. 6 shows how the new crystal does not grow in this invention, as seen also from the upper portion of the vane 8. In FIG. 6 numeral 18 denotes a grain boundary, and numeral 19 denotes the new crystal. This invention makes it possible for the single crystal to grow, instead of a new crystal growing.

Figure 7:
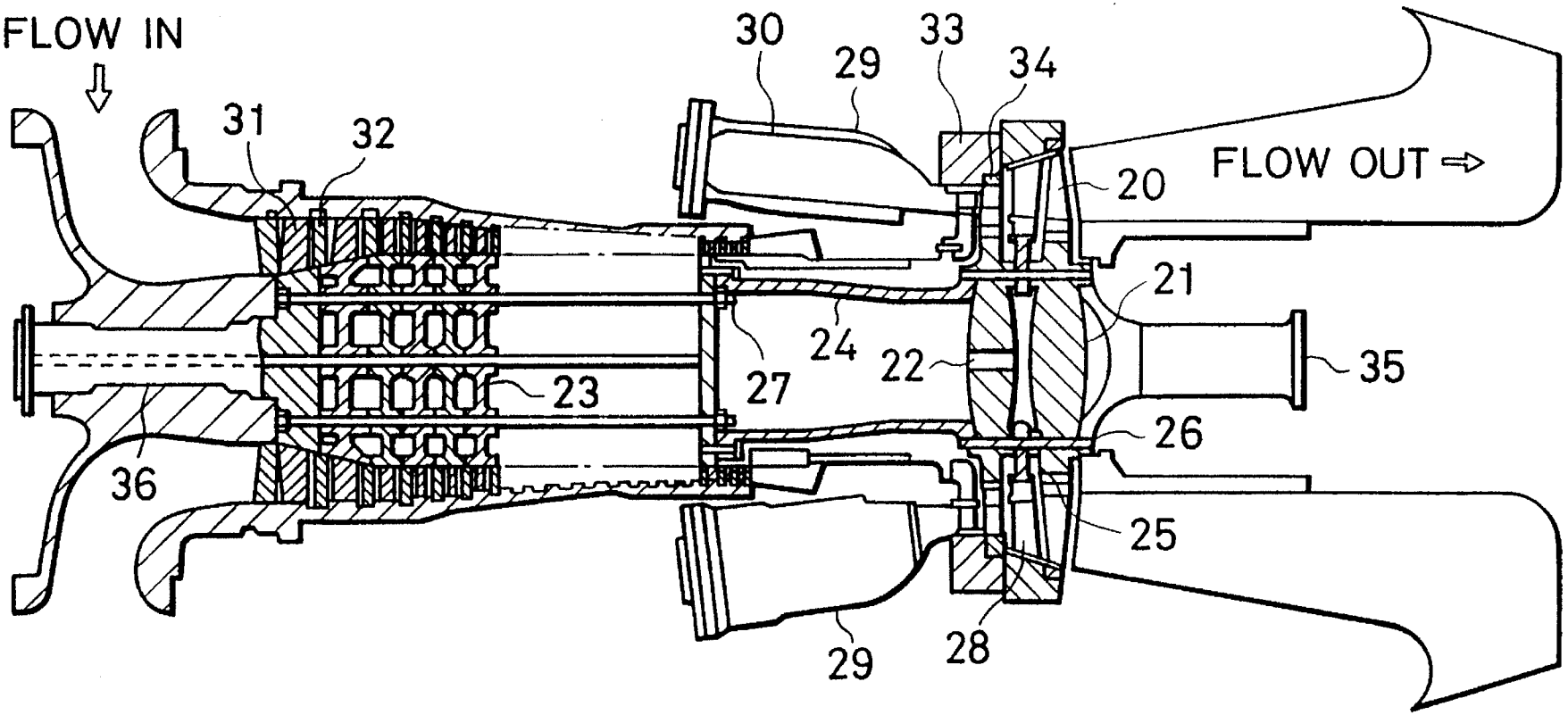
FIG. 7 is a cross-sectional view showing the rotary portion of a gas turbine in accordance with this invention.

FIG. 7 is a partial cross-sectional view showing the rotary portion of a gas turbine. In the drawing, the Ni-base alloy of No. 2 made of the single crystal, obtained in the first embodiment of this invention, is used for a first turbine blade 20. In this embodiment, a turbine disk 21 has two stages. The first stage is disposed upstream of a gas flow, whereas, the second stage, having a central hole 22 formed therein, is disposed downstream of the gas flow. A martensitic heat resisting steel containing 12% Cr is used for the final stage of a compressor disk 23, a distant piece 24, a turbine spacer 25, a turbine stacking bolt 26 and a compressor stacking bolt 27. The turbine blade 20 in a second stage, a turbine nozzle 28, the liner 30 of a combustor 29, a compressor blade 31, a compressor nozzle 32, diaphragm 33 and a shroud 34 are made of alloys. The elements contained in these alloys are shown in Table 5. The turbine nozzle 28 in a first stage and the turbine blade 20 are made of a single-crystal casting. The turbine nozzle 28 in the first stage is made of alloy No. 13, and is composed of one segment for each vane in the same manner as in the turbine blade.

TABLE 5

| | | C | Si | Mn | Cr | Ni | Co | Fe | Mo | B | W | Ti | Others |
|---|---|---|---|---|---|---|---|---|---|---|---|---|---|
| Turbine Blade | | 0.15 | 0.11 | 0.12 | 15.00 | Bal | 9.02 | — | 3.15 | 0.015 | 3.55 | 4.11 | Zr0.05, A15.00 |
| Turbine Nozzle | | 0.43 | 0.75 | 0.66 | 29.16 | 10.18 | Bal | — | — | 0.010 | 7.11 | 0.23 | Nb0.21, Zr0.15 |
| Liner Combustor | | 0.07 | 0.83 | 0.75 | 22.13 | Bal | 1.57 | 18.47 | 9.12 | 0.008 | 0.78 | — | — |
| Compressor Blade, Nozzle | | 0.11 | 0.41 | 0.61 | 12.07 | 0.31 | — | Bal | — | — | — | — | — |
| Shroud Segment | (1) | 0.08 | 0.87 | 0.75 | 22.16 | Bal | 1.89 | 18.93 | 9.61 | 0.005 | 0.85 | — | — |
| | (2) | 0.41 | 0.65 | 1.00 | 23.55 | 25.63 | — | Bal | — | — | — | 0.25 | Nb 0.33 |
| Diaphragm | | 0.025 | 0.81 | 1.79 | 19.85 | 11.00 | — | Bal | — | — | — | — | — |

The turbine nozzle 28 is disposed on a circumference, and has a diaphragm and a length which is substantially equal to the vane of the blade. Numeral 35 denotes a turbine stub shaft, and numeral 36 denotes a compressor stub shaft. A compressor used in this embodiment has seventeen stages. The turbine blade, the turbine nozzle, a first shroud segment and the diaphragm, all shown in FIG. 7, are used in the first stage upstream of the gas flow, whereas, a second shroud segment is used in the second stage.

In this embodiment, a layer made of a highly concentrated alloy containing Al, Cr and other elements, or made of a mixture containing oxides, may be used as a coating layer which is resistant to oxidation and corrosion at temperatures higher than those at which an alloy serving as a base material is resistant to oxidation and corrosion.

The crystal may be formed so that its orientation becomes (0013) in the direction in which a centrifugal force is applied. A blade having high strength is obtainable by forming the crystal in this way.

According to the gas turbine thus constructed, when electricity on the order of 50 Mw is generated, the gas temperature at the entrance of the turbine nozzle in the first stage is capable of rising as high as 1500° C., and the metal temperature at the blade in the first stage is capable of rising as high as 1000° C. Thirty four percent thermal efficiency is obtainable. As mentioned above, the heat resisting steel having higher creep rupture strength and fewer defects caused by heat is used for the turbine disk, the distant piece, the spacer, the final stage of the compressor disk, and the stacking bolt. The alloy having strength at high temperatures is used for the turbine blade; the alloy having strength and ductility at high temperatures is used for the turbine nozzle; and the alloy having high fatigue performance and strength at high temperatures is used for the liner of the combustor.

It is thus possible to obtain a gas turbine which is more reliable in various aspects than the conventional art.

What is claimed is:

1. A heavy-duty gas turbine comprising:

a compressor;

a combustion liner;

a turbine blade, in a single stage or multi-stages, which has a dovetail secured to a turbine disk and has an overall length of not less than 180 mm, and which is made of a single-crystal Ni-base alloy whose γ phase is a single crystal, said Ni-base alloy having a composition in weight percent containing 0.15% or less C, 2% or less Mn, 5–18.4% Cr, 1–12% A1, 5% or less Ti, 2.0% or less Nb, 1.5–15% W, 5% or less Mo, 12% or less Ta, 15.0% or less Co, 0.2% or less Hf, 3.0% or less Re, and 0.02% or less B; and a turbine nozzle provided in correspondence to said turbine blade;

wherein operating gas temperature is not less than 1400° C., and metal temperature of a first blade is not less than 1000° C. under working stress.

2. A gas turbine blade comprising:

a dovetail serving as a portion secured to a disk;

a shank which is connected to said dovetail and has one or more protrusions integrally formed on the side of said dovetail; and a wing connected to said shank;

wherein said gas turbine blade is made of a Ni-base alloy in which a γ' phase is precipitated substantially in a γ phase which is formed in a single-crystal structure, said Ni-base alloy having a composition in weight percent containing 0.15% or less C, 2% or less Mn, 5–18.4% Cr, 1–12% A1, 5% or less Ti, 2.0% or less Nb, 1.5–15% W, 5% or less Mo, 12% or less Ta, 15.0% or less Co, 0.2% or less Hf, 3.0% or less Re, and 0.02% or less B.

3. A gas turbine blade according to claim 2, wherein the protrusions provided in said shank are sealing portions, in a single stage or multi-stages, provided on both surfaces along a surface where said wing rotates.

4. A gas turbine blade according to claim 3 having a structure in which the edge of each sealing portion bends toward said wing and slides with respect to a nozzle so as to seal a gas flow.

5. A gas turbine blade according to claim 2, wherein the protrusion provided in said shank is one platform provided on both surfaces intersecting with the surface where said wing rotates.

6. A gas turbine blade according to claim 2, wherein said shank, in which the protrusions are provided, has a cross-section area of not less than 15 $cm^2$.

7. A gas turbine blade according to claim 3, wherein said shank, in which the protrusions are provided, has a cross-section area of not less than 15 $cm^2$.

8. A gas turbine blade according to claim 4, wherein said shank, in which the protrusions are provided, has a cross-section area of not less than 15 $cm^2$.

9. A gas turbine blade according to claim 5, wherein said shank, in which the protrusions are provided, has a cross-section area of not less than 15 $cm^2$.

10. A gas turbine blade according to claim 2, wherein said shank and said wing including the dovetail and the protrusions are made of the Ni-base alloy in which the $\gamma'$ phase is precipitated in a single-crystal base of the $\gamma$ phase.

11. A gas turbine blade according to claim 3, wherein said shank and said wing including the dovetail and the protrusions are made of the Ni-base alloy in which the $\gamma'$ phase is precipitated in a single-crystal base of the $\gamma$ phase.

12. A gas turbine blade according to claim 4, wherein said shank and said wing including the dovetail and the protrusions are made of the Ni-base alloy in which the $\gamma'$ phase is precipitated in a single-crystal base of the $\gamma$ phase.

13. A gas turbine blade according to claim 5, wherein said shank and said wing including the dovetail and the protrusions are made of the Ni-base alloy in which the $\gamma'$ phase is precipitated in a single-crystal base of the $\gamma$ phase.

14. A gas turbine blade according to claim 6, wherein said shank and said wing including the dovetail and the protrusions are made of the Ni-base alloy in which the $\gamma'$ phase is precipitated in a single-crystal base of the $\gamma$ phase.

15. A gas turbine blade according to claim 2 having an overall length of not less than 180 mm in a longer direction thereof.

16. A gas turbine blade according to claim 3 having an overall length of not less than 180 mm in a longer direction thereof.

17. A gas turbine blade according to claim 4 having an overall length of not less than 180 mm in a longer direction thereof.

18. A gas turbine blade according to claim 5 having an overall length of not less than 180 mm in a longer direction thereof.

19. A gas turbine blade according to claim 6 having an overall length of not less than 180 mm in a longer direction thereof.

20. A gas turbine blade according to claim 10 having an overall length of not less than 180 mm in a longer direction thereof.

21. A gas turbine blade according to claim 2, wherein said wing weighs not more than 30% of the overall weight of said gas turbine blade.

22. A gas turbine blade according to claim 3, wherein said wing weighs not more than 30% of the overall weight of said gas turbine blade.

23. A gas turbine blade according to claim 4, wherein said wing weighs not more than 30% of the overall weight of said gas turbine blade.

24. A gas turbine blade according to claim 5, wherein said wing weighs not more than 30% of the overall weight of said gas turbine blade.

25. A gas turbine blade according to claim 6, wherein said wing weighs not more than 30% of the overall weight of said gas turbine blade.

26. A gas turbine blade according to claim 10, wherein said wing weighs not more than 30% of the overall weight of said gas turbine blade.

27. A gas turbine blade according to claim 15, wherein said wing weighs not more than 30% of the overall weight of said gas turbine blade.

28. A gas turbine blade comprising:

a dovetail serving as a portion secured to a disk;

a shank which is connected to said dovetail and has one or more protrusions integrally formed on the side of said dovetail; and a wing connected to said shank;

wherein said gas turbine blade is solidified from the edge of said wing to said dovetail by a unidirectional solidification process, a $\gamma$ phase being made of a single-crystal Ni-base alloy having a composition in weight percent containing 0.15% or less C, 2% or less Mn, 5–18.4% Cr, 1–12% Al, 5% or less Ti, 2.0% or less Nb, 1.5–15% W, 5% or less Mo, 12% or less Ta, 15.0% or less Co, 0.2% or less Hf, 3.0% or less Re, and 0.02% or less B.

29. A heavy-duty gas turbine comprising:

a turbine disk;

at least one stage of a turbine blade which has a dovetail secured to the turbine disk, with a shank being connected to said dovetail and having one or more protrusions integrally formed on the side of said shank, with a platform being connected to said shank, and with a vane being connected to said platform in a way that said platform extends substantially sideways from said vane, and said blade having an overall length of not less than 160 mm, and as a whole being made of a Ni-base alloy in which a $\gamma'$ phase is precipitated in a $\gamma$ phase which is formed in a single crystal which extends throughout the entire gas turbine blade; and a turbine nozzle provided in correspondence to said turbine blade;

wherein operating combustion gas temperature is not less than 1400° C., and said turbine nozzle is constituted by a single crystal structure of Co-base alloy.

30. The heavy duty gas turbine according to claim 29, wherein said Co-base alloy comprises 0.2–0.6%C, 0.5% or less Si, 2% or less Mn, 20–30% Cr, 20% or less Ni, 5% or less Mo, 2–15% W, 5 or less Nb, 0.5% or less Ti, 0.5% or less Al, 5% or less Fe, 0.02% or less B, 0.5% or less Zr, and 5% or less Ta.

* * * * *